United States Patent [19]

Matsuoka et al.

[11] Patent Number: 5,041,166

[45] Date of Patent: Aug. 20, 1991

[54] COLD-ROLLED STEEL SHEET FOR DEEP DRAWING AND METHOD OF PRODUCING THE SAME

[75] Inventors: Saiji Matsuoka; Susumu Satoh; Hideo Abe, all of Chiba; Nobuhiko Uesugi, Kurashiki, all of Japan

[73] Assignee: Kawasaki Steel Corporation, Japan

[21] Appl. No.: 576,661

[22] Filed: Aug. 31, 1990

[30] Foreign Application Priority Data

Sep. 11, 1989 [JP] Japan ..... 1-232699
Sep. 11, 1989 [JP] Japan ..... 1-232700

[51] Int. Cl.[5] ..... C21D 8/04

[52] U.S. Cl. ..... 148/12 C; 148/12 F; 148/320

[58] Field of Search ..... 148/12 C, 12 F, 320

[56] References Cited

U.S. PATENT DOCUMENTS

| | | | |
|---|---|---|---|
| 4,504,326 | 3/1985 | Tokunaga et al. | 148/12 C |
| 4,517,031 | 5/1985 | Takasaki et al. | 148/12 C |
| 4,586,966 | 5/1986 | Okamoto et al. | 148/12 C |
| 4,818,299 | 4/1989 | Sato et al. | 148/12 F |
| 4,961,793 | 10/1990 | Kishida et al. | 148/12 F |

*Primary Examiner*—Deborah Yee
*Attorney, Agent, or Firm*—Austin R. Miller

[57] ABSTRACT

A cold-rolled steel sheet suitable for deep drawing has a composition containing up to about 0.005 wt % of C, up to about 0.1 wt % of Si, up to about 1.0 wt % of Mn, up to about 0.1 wt % of P, up to about 0.05 wt % of S, about 0.01 to 0.10 wt % of Al, up to about 0.005 wt % of N, one, two or more elements selected from the group consisting of about 0.01 to 0.15 wt % of Ti, about 0.001 to 0.05 wt % of Nb and about 0.0001 to 0.0020 wt % of B, and the balance substantially Fe and incidental impurities. The steel sheet exhibits a Lankford value (r-value) of about $\bar{r} \geqq 2.8$ and also exhibits the difference ($r_{max} - r_{min}$) between the maximum value $r_{max}$ and the minimum value $r_{min}$ satisfying the condition of ($r_{max} - r_{min}$) $\leqq$ about 0.5. The steel sheet is produced by a process having the steps of: conducting hot-rolling on the steel material of the above-described composition; conducting a primary cold rolling at a rolling reduction not smaller than about 30%; conducting intermediate annealing at a temperature ranging between the recrystallization temperature and about 920°; conducting secondary cold rolling at a rolling reduction not smaller than about 30% so as to provide a total rolling reduction not smaller than about 78%; and conducting final annealing at a temperature which is between the recrystallization temperature and about 920° C.

7 Claims, 4 Drawing Sheets

COLD-ROLLED STEEL SHEET FOR DEEP DRAWING AND METHOD OF PRODUCING THE SAME

BACKGROUND OF THE INVENTION

1. Field of the Invention

The present invention relates to a cold-rolled steel sheet which is superior both in deep drawability and internal anisotropy or stiffness and which is suitable for use as the material of automotive panels and other parts. The invention also is concerned with a method of producing such a cold-rolled steel sheet.

2. Description of the Prior Art

Cold-rolled steel sheets to be used as materials of automotive panels are required to have superior deep drawability. To this end, the cold-rolled steel sheet is required to have a high Lankford value (referred to as r-value) and a high ductility (El).

Hitherto, assembly of an automobile has been conducted by preparing a large number of pressed parts and assembling these parts by spot welding. A current trend, however, is to integrate some of these parts into one piece of a large size, so as to reduce the number of parts and the number of welding spots, in order to improve the product quality while reducing the cost.

For instance, an oil pan of an automobile which has a very complicated form is usually fabricated by welding a plurality of segments. In recent years, however, there is an increasing demand by automotive manufacturers for integral formation of the oil pan. On the other hand, the designs of automobiles are sophisticated and complicated, in order to cope with the demand for diversification of the needs. Consequently, there exist many complicated parts which cannot be formed from conventional steel sheets. Thus, cold-rolled steels having much more superior deep drawability than known steel sheets are being demanded.

Internal anisotropy of the Lankford value (r-value) is a significant factor for successfully carrying out deep drawing. More specifically, the internal anisotropy of the material has to meet the condition of $r_{max}-r_{min} \leqq 0.5$, where $r_{max}$ and $r_{min}$ respectively represent the maximum and minimum values of the Lankford value.

Another significant factor for integral formation is the stiffness of the material. More specifically, the cold-rolled steel sheet is required to have a Young's modulus of about 23000 kgf/mm$^2$ as a mean value.

Hitherto, various methods have been proposed for improving deep drawability. For instance, Japanese Examined Patent Publication Nos. 44-17268, 44-17269 and 44-17270 disclose methods in which a low-carbon rimmed steel is subjected to two stages of cold rolling and annealing, so that the r-value is increased to 2.18. This level of r-value, however, cannot provide sufficient deep drawability any more. A publication "IRON AND STEEL (1971), 5280" discloses that a steel sheet for ultra-deep drawing having an r-value of 3.1 can be obtained by preparing a steel having a composition containing C: 0.008 wt %, Mn: 0.31 wt %, P: 0.012 wt %, S: 0.015 wt %, N: 0.0057 wt %, Al : 0.036 wt % and Ti: 0.20 wt %, subjecting the steel to a primary rolling at a rolling reduction of 50%, an intermediate annealing at 800° C. for 10 hours, a secondary rolling at rolling ratio of 80% and a final annealing at 800° C. for 10 hours. This method, however, cannot provide sheet thickness of ordinarily used sheets which is 0.6 mm or greater, because the total cold rolling reduction is as large as 90%. In addition, this publication does nor mention not suggest any anisotropy of the r-value and the young's modulus.

Proposals have been made also for production of cold-rolled steel sheets having superior stiffness. For instance, Japanese Unexamined Patent Publication No. 57-81361 discloses a method in which a cold-rolled steel sheet having a superior stiffness of 23020 kgf/mm$^2$ in terms of Young's modulus (mean value) is obtained by preparing a steel of a composition containing C: 0.002 wt %, Si: 0.02 wt %, Mn: 0.42 wt %, P: 0.08 wt %, S: 0.011 wt %, N: 0.0045 wt %, Al: 0.03 wt % and B: 0.0052 wt %, cold rolling the steel and then subjecting the steel to continuous annealing at 850° C. for 1 minute. This publication also fails to mention any r-value of the material and, hence, no specific consideration is given to deep drawability.

SUMMARY OF THE INVENTION

Accordingly, an object of the present invention is to provide a cold-rolled steel sheet having remarkably improved deep drawability and small internal anisotropy or superior stiffness, through a novel combination of the steel composition and conditions for cold-rolling and annealing.

Another object of the present invention is to provide a method of producing such a cold-rolled steel.

To these ends, according to one aspect of the present invention, there is provided a cold-rolled steel sheet suitable for deep drawing, the steel sheet being made from a steel having a composition containing up to about 0.005 wt % of C, up to about 0.1 wt % of Si, up to about 1.0 wt % of Mn, up to about 0.1 wt % of P, up to about 0.05 wt % of S, about 0.01 to 0.10 wt % of Al, up to about 0.005 wt % of N, one, two or more elements selected from the group consisting of about 0.01 to 0.15 wt % of Ti, about 0.001 to 0.05 wt % of Nb and about 0.0001 to 0.0020 wt % of B, and the balance substantially Fe and incidental impurities; the steel sheet exhibiting a Lankford value (r-value) of about $\bar{r} \geqq 2.8$ and the difference $(r_{max} - r_{min})$ between the maximum value $r_{max}$ and the minimum value $r_{min}$ satisfying the condition of $(r_{max} - r_{min}) \leqq$ about 0.5. Alternatively, the cold-rolled steel sheet exhibits the above-mentioned range of the Lankford value and a Young's modulus of about 23000 kg/mm$^2$ or greater.

According to another aspect of the present invention, there is provided a method of producing a cold-rolled steel sheet suitable for deep drawing, comprising: preparing a blank steel material having the above-mentioned composition; subjecting the material to hot rolling; conducting primary cold rolling on the material at a rolling reduction not smaller than about 30%; conducting intermediate annealing on the material at a temperature ranging between the recrystallization temperature and about 920°; conducting a secondary cold rolling on the material at a rolling reduction equal to or greater than about 30% so as to provide a total rolling reduction equal to or greater than about 78%; and conducting a final annealing on the material at a temperature which is between the recrystallization temperature and about 920° C.

The above and other objects, features and advantages of the invention will become clear from the following detailed description taken in conjunction with the drawings.

DETAILED DESCRIPTION OF THE INVENTION

A description will be given of the results of studies and experiments on the basis of actual examples on which the present invention has been accomplished.

A steel slab was prepared to have a composition containing C: 0.002 wt %, Si: 0.01 wt %, Mn: 0.11 wt %, P: 0.010 wt %, S: 0.011 wt %, Al: 0.05 wt %, N: 0.002 wt %, Ti: 0.032 wt %, Nb: 0.008 wt % and the balance substantially Fe. The steel slab was hot-rolled to a sheet thickness of 6 mm and then subjected to a series of steps including primary cold rolling at a rolling reduction of 66%, intermediate annealing, secondary cold rolling at a rolling reduction of 66% and final annealing at 870° C. for 20 seconds. This process was conducted on a plurality of test samples while varying the temperature of the intermediate annealing, and the $\bar{r}$-values mean Lankford values of these test samples after final annealing were measured The re-crystallization temperature of this steel was about 720° C.

Figure 1:
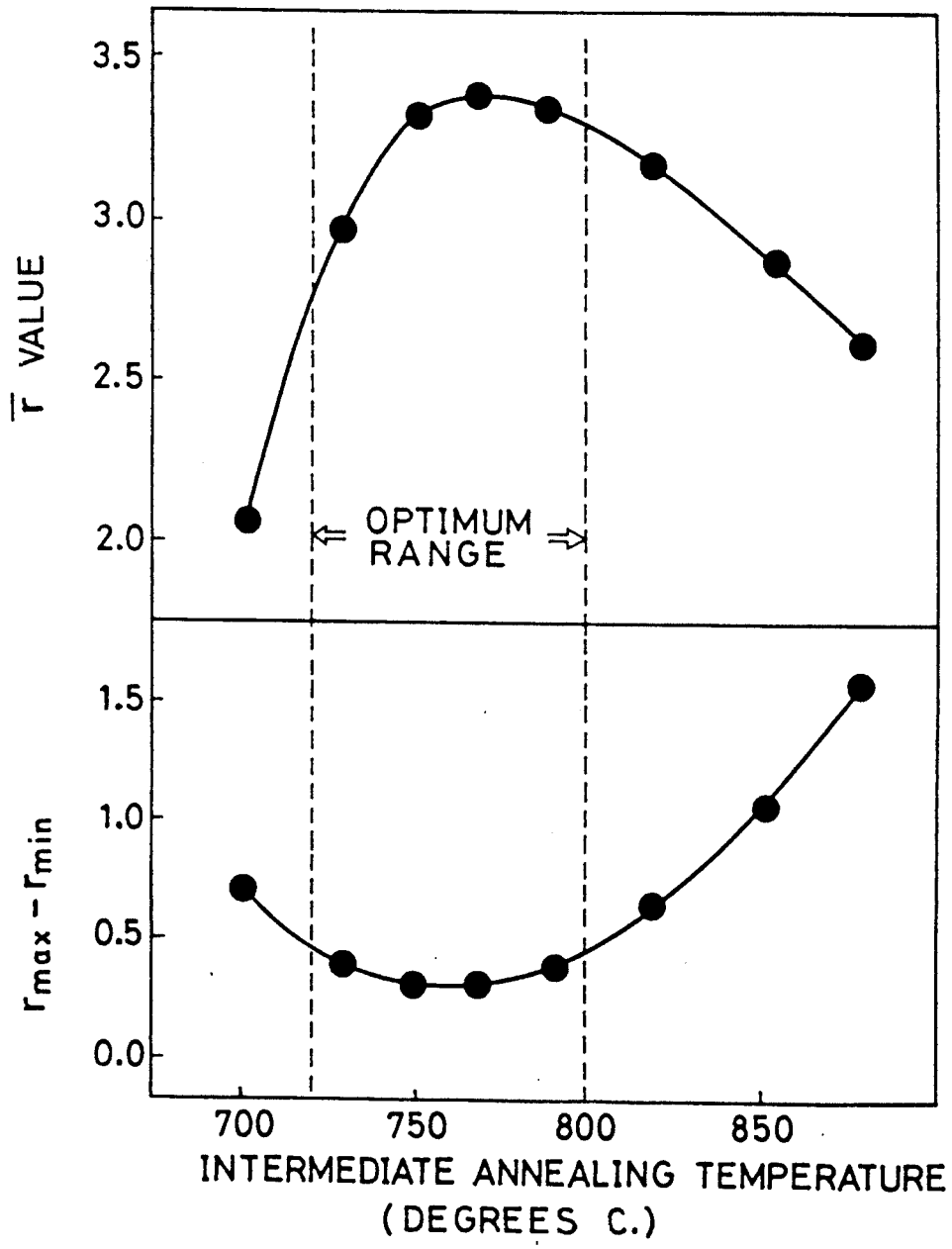
FIG. 1 is a diagram showing the influence of annealing temperature on the $\bar{r}$-value and the internal anisotropy ($r_{max} - r_{min}$) of the steel after final annealing.

FIG. 1 shows the results of measurement of influence of intermediate annealing on the r-value and the internal anisotropy ($r_{max} - r_{min}$). As will be seen from this Figure, the $\bar{r}$-value and the internal anisotropy ($r_{max} - r_{min}$) exhibit large dependencies on the intermediate annealing temperature. Conditions of $\bar{r} \geqq 2.8$ and $r_{max} - r_{min} \geqq 0.5$ were obtained when the intermediate annealing temperature ranged between the re-crystallization temperature and the temperature which is recrystallization temperature plus (+) 80° C.

A steel slab was prepared to have a composition containing C: 0.002 wt %, Si: 0.02 wt %, Mn: 0.13 wt %, P: 0.011 wt %, S: 0.010 wt %, Al: 0.05 wt %, N: 0.002 wt %, Ti: 0.031 wt %, Nb: 0.007 wt % and the balance substantially Fe. The steel slab was hot-rolled to a sheet thickness of 6 mm and then subjected to a series of steps including primary cold rolling, intermediate annealing at 850° C. for 20 seconds, secondary cold rolling and final annealing at 850° C. for 20 seconds. This process was conducted on a plurality of test samples with the total rolling reduction maintained constant at 88%, while varying the rolling reductions in the primary and secondary cold rolling operations, and the $\bar{r}$-values and the Young's modulus of these test samples after the final annealing were measured. Young's modulus was measured in three directions: namely, the L direction which coincides with the rolling direction, the D direction which forms 45° to the rolling direction and the C direction which forms 90° to the rolling direction, and the mean of the measured values was used as the Young's modulus.

Figure 3:
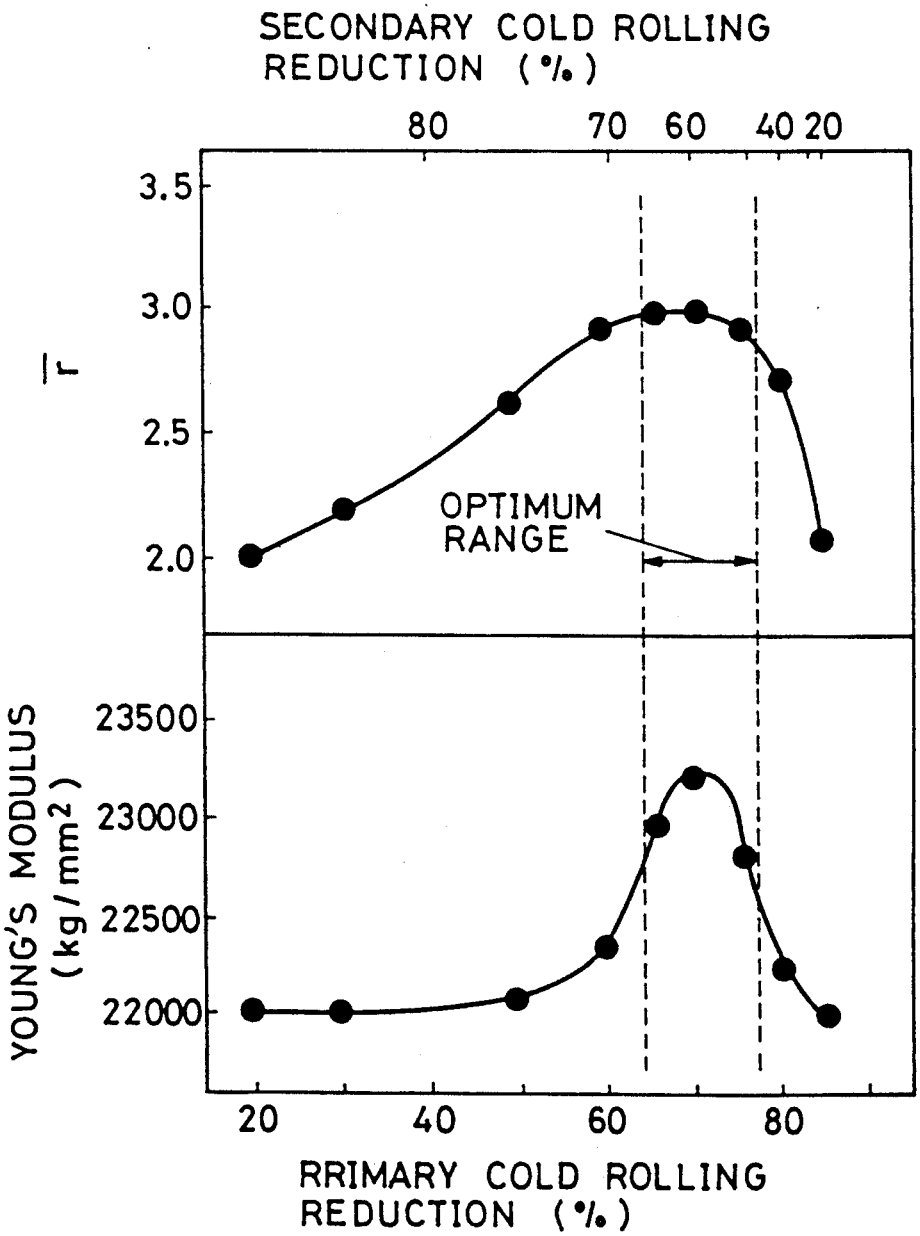
FIG. 3 is a graph showing the influence of the proportions of rolling reduction in primary and secondary cold-rolling stages on the $\bar{r}$-value and the Young's modulus of the material after final annealing.

FIG. 3 shows the results of measurement of influence of the proportions of the rolling reductions of the primary and secondary cold rolling on the $\bar{r}$-value and the Young's modulus of the material after final annealing. As will be seen from this Figure, the $\bar{r}$-value and the Young's modulus exhibit large dependencies on the proportions of the rolling reductions. As will be seen from FIG. 3, in order to obtain a larger value, it is necessary that the primary cold rolling has to be conducted at a rolling reduction of at least 50%. It has been found also that, in order to simultaneously obtain a large $\bar{r}$-value and a large Young's modulus, it is important to conduct the primary cold rolling at a rolling reduction of at least 50%, while effecting the secondary rolling reduction at a rolling reduction somewhat smaller than that of the primary rolling reduction.

Figure 4:
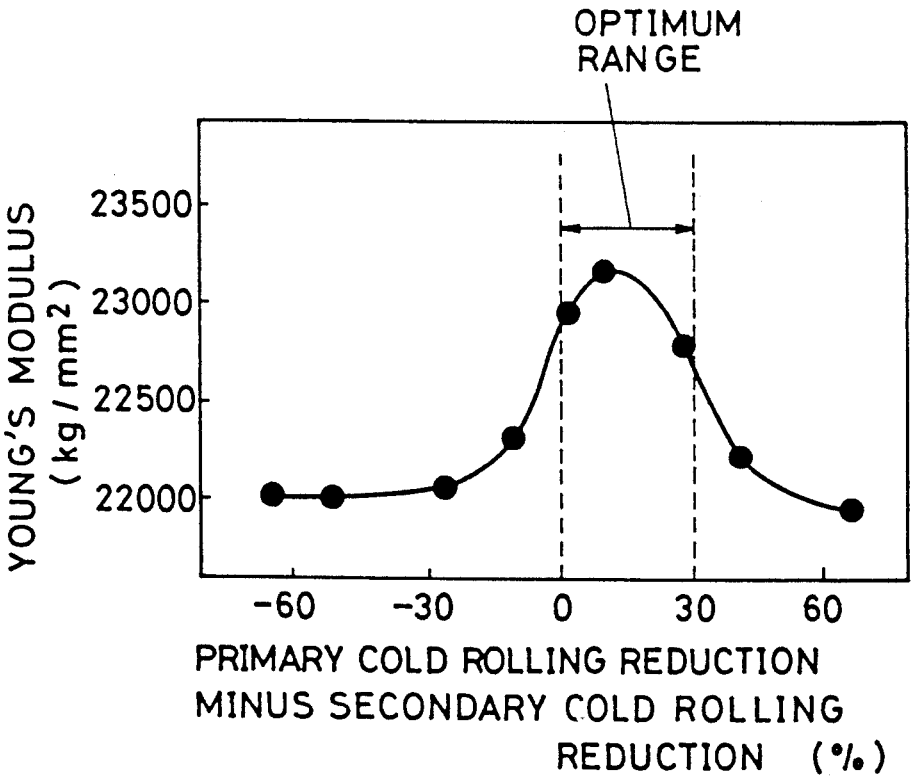
FIG. 4 is graph showing the influence of the proportions of rolling reduction in primary and secondary cold-rolling stages on the Young's modulus of the material after final annealing.

FIG. 4 shows the results of the measurement, in terms of the relationship between the Young's modulus and the difference between the primary cold rolling reduction and the secondary cold rolling reduction. As will be seen from this Figure, it was found that good values of Young's modulus can be obtained when the difference in the rolling reductions between the primary and secondary cold rolling stages is up to but not greater than about 30%.

A description will now be given of the ranges or numerical restrictions of important factors in the present invention.

(1) Steel composition

The steel composition is a significant factor in the present invention.

The steel should have a composition containing up to about 0.005 wt % of C, up to about 0.1 wt % of Si, up to about 1.0 wt % of Mn, up to about 0.1 wt % of P, up to about 0.05 wt % of S, about 0.01 to 0.10 wt % of Al, and up to about 0.005 wt % of N, and should contain also one, two or more elements selected from the group consisting of about 0.01 to 0.15 wt % of Ti, about 0.001 to 0.05 wt % of Nb and about 0.0001 to 0.0020 wt % of B. It is also possible to add about 0.001 to 0.02 wt % of Sb as required.

A description will now be given of the reasons so far as known to us, for limitation of the contents of the steel components.

C: not more than about 0.005 wt %

For attaining high deep drawability, the C content is preferably small. The C content, however, does not substantially affect the deep drawability when it is not more than about 0.005 wt %. For this reason, the C content is determined to be up to but not more than about 0.005 wt %.

Si: not more than about 0.1 wt %

Si is an element which strengthens the steel and is added in a suitable amount according to the strength to be attained. Addition of this element in excess of about 0.1 wt %, however, adversely affects deep drawability, so that the content of this element is determined to be up to but not more than about 0.1 wt %.

Mn: not more than about 1.0 wt %

Mn also is an element which strengthens the steel and is added in a suitable amount according to the strength to be attained. Addition of this element in excess of about 1.0 wt %, however, adversely affects deep drawability, so that the content of this element is determined to be up to but not more than about 1.0 wt %.

P: not more than about 0.1 wt %

P also is an element which strengthens the steel and is added in a suitable amount according to the strength to be attained. Addition of this element in excess of about 0.1 wt %, however, adversely affects deep drawability, so that the content of this element is determined to be up to but not more than about 0.1 wt %.

S: not more than about 0.05 wt %

For attaining high deep drawability, the S content is preferably small because deep drawability increases as the S content becomes smaller. The S content, however, does not substantially affect deep drawability when it is not more than about 0.005 wt %. For this reason, the S content is determined to be up to but not more than about 0.05 wt %.

Al: about 0.01 to 0.10 wt %

Al as a deoxidizer is added for the purpose of improving the yield of a later-mentioned carbonitride former. The effect of addition of Al is not appreciable when the content is below about 0.010 wt % and is saturated when the content exceeds about 0.10 wt %. For these reasons, the Al content is determined to be from about 0.01 to 0.10 wt %.

N: not more than about 0.005 wt %

For attaining a high deep drawability, the N content is preferably small because the deep drawability increases as the N content becomes smaller. The N content, however, does not substantially affect the deep drawability when it is not more than about 0.005 wt %. For this reason, the N content is determined to be not more than about 0.005 wt %.

Ti: about 0.01 to 0.15 wt %

Ti is a carbonitride former and is added for the purpose of reducing solid solution of C and N in the steel thereby to preferentially form [111] crystal orientation which improves deep drawability. The effect of addition of this element, however, is not appreciable when the content is below about 0.01 wt %, whereas, addition of this element in excess of about 0.15 wt % merely causes a saturation effect and, rather, degrades the nature of the surface of the steel sheet and impairs its ductility. For these reasons, the Ti content is determined to be from about 0.01 to 0.15 wt %.

Nb: about 0.001 to 0.05 wt %

Nb is a carbonitride former and is added for the purpose of reducing solid solution of C in the steel so as to promote refining of the hot-rolled sheet structure, thereby to preferentially form [111] crystal orientation which improves deep drawability. The effect of addition of this element, however, is not appreciable when the content is below about 0.001 wt %, whereas, addition of this element in excess of about 0.05 wt % merely causes a saturation effect and, rather, degrades the nature of the surface of the steel sheet and impairs its ductility. For these reasons, the Nb content is determined to be from about 0.001 to 0.05 wt %.

B: about 0.0001 to 0.0020 wt %

B is an element which contributes to the improvement in the resistance to secondary work embrittlement. The effect of addition of this element, however, is not appreciable when its content is below about 0.0001 wt %. On the other hand, addition of this element in excess of about 0.0020 wt % impairs the deep drawability. For these reasons, the B content is determined to be from about 0.0001 to 0.0020 wt %.

Sb: about 0.001 to 0.02 wt %

Sb is an element which is effective in preventing nitriding of the steel during batch-type annealing. The effect, however, is not appreciable when the content is below about 0.001 wt %. However, the nature of the surface of the steel sheet is degraded when the content exceeds about 0.020 wt %. For these reasons, the Sb content is determined to be from about 0.001 to 0.02 wt %.

(2) Conditions of Cold Rolling and Annealing

The conditions of cold rolling and annealing are most important factors in the present invention.

The cold rolling and annealing are conducted on a steel sheet having a composition containing not more than about 0.005 wt % of C, not more than about 0.1 wt % of Si, not more than 1.0 wt % of Mn, not more than about 0.1 wt % of P, not more than about 0.05 wt % of S, about 0.01 to 0.10 wt % of Al, not more than about 0.005 wt % of N, one, two or more elements selected from the group consisting of about 0.01 to 0.15 wt % of Ti, about 0.001 to 0.05 wt % of Nb and about 0.0001 to 0.0020 wt % of B, and the balance substantially Fe and incidental impurities.

The cold rolling and annealing should be effected through a series of steps including primary cold rolling at a rolling reduction not smaller than about 30%, an intermediate annealing at a temperature ranging between the recrystallization temperature and about 920°, a secondary cold rolling conducted at a rolling reduction of not smaller than about 30% so as to provide a total rolling reduction not smaller than about 78%, and a final annealing at a temperature which is between the recrystallization temperature and about 920° C.

It is possible to attain an r-value of $\bar{r} \geqq 2.8$ and internal anisotropy ($r_{max} - r_{min}$) of ($r_{max} - r_{min}$) $\leqq 0.5$, when the intermediate annealing and the final annealing are respectively conducted at a temperature between the recrystallization temperature and a temperature about 80° C. higher than the recrystallization temperature and at a temperature which is between the temperature about 50° C. higher than the intermediate annealing temperature and about 920° C. It is also possible to simultaneously attain both an $\bar{r}$-value of $\bar{r} \geqq 2.8$ and a Young's modulus of 23,000 kg/mm$^2$ of greater when the process is carried out to include the steps of a primary cold rolling at a rolling reduction not less than about 50%, an intermediate annealing at a temperature between a temperature which is about 80° C. higher than the recrystallization temperature and and about 920° C., a secondary cold rolling conducted at a rolling reduction which is smaller than that of the first cold rolling, the difference between the rolling reductions of the primary and secondary cold rolling being not greater than about 30%.

When the rolling reduction is below about 30% in each of the primary and secondary cold rolling operations, it is impossible to obtain a good rolled collective structure in the cold rolling, making it difficult to form the [111] crystal orientation advantageous for deep drawability in each annealing, in the intermediate annealing or in the final annealing. As a consequence, the preferential formation of the [111] crystal orientation tends to fail, with the result that deep drawability is impaired.

Figure 2:
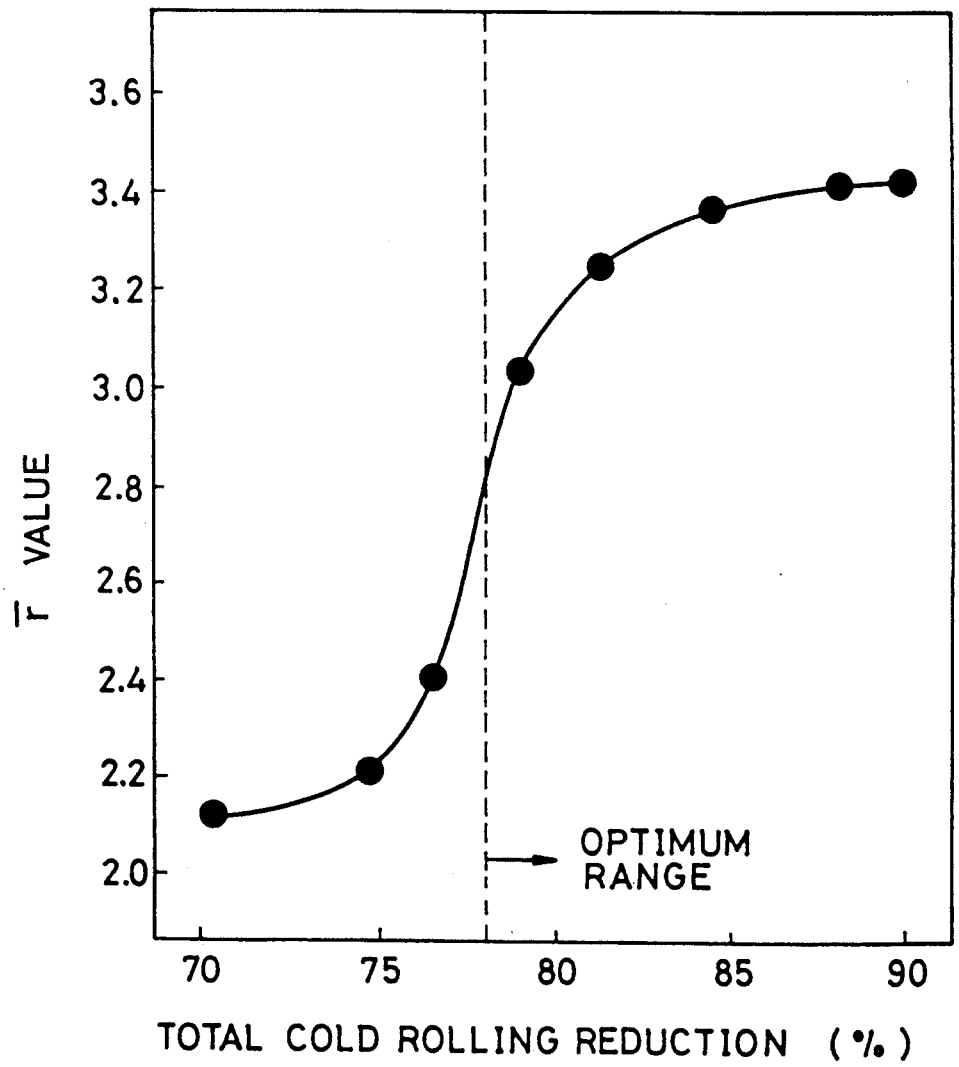
FIG. 2 is a graph showing the influence of the total cold-rolling reduction on the $\bar{r}$-value of the steel after final annealing.

FIG. 2 illustrates the relationship between the total rolling reduction and the r-value. As will be seen from this Figure, it is impossible to obtain a strong [111] crystal orientation after final annealing and, hence, to attain a large $\bar{r}$-value, when the total rolling reduction is below about 78%.

In order to attain a high Young's modulus, it is necessary that the rolling reduction in the secondary cold rolling is smaller than that of the primary rolling reduction and that the difference between these rolling reductions is up to but not greater than about 30%. The reason for this fact has not been clarified as yet. Considering that the Young's modulus depends on the collective structure, however, it is considered that the cold rolling operations at such rolling reductions together with the intermediate and final annealing operations provide a recrystallized collective structure which maximizes the mean value of the Young's modulus.

Both the intermediate annealing and the final annealing may be conducted by a continuous annealing method or by a batch-type annealing method. The intermediate annealing, however, must be conducted at a temperature ranging between the recrystallization temperature and about 920° C. When the intermediate annealing is effected at a temperature which is below the recrystallization temperature, many crystals of [100] orientation crystals are formed in the intermediate annealing so that deep drawability is impaired in the product obtained through subsequent secondary cold rolling and the final annealing. On the other hand, when the annealing is conducted at a temperature higher than about 920° C., a random crystal orientation is formed due to $\alpha$- to $\gamma$- phase transformation.

In order to reduce the internal anisotropy of the r-value, it is necessary that the intermediate annealing is conducted at a temperature between the recrystallization temperature and a temperature which is about 80° C. higher than the recrystallization temperature and that the final annealing is conducted at a temperature which is not lower than a temperature about 50° C. above the intermediate annealing temperature and not higher than about 920° C. When the intermediate annealing is effected at a temperature above the temperature about 803C higher than the recrystallization temperature, the recrystallized crystal grains become coarse so that many crystals of [110] orientation are produced after the subsequent secondary cold rolling and the final annealing, resulting in a large internal anisotropy of the r-value. When the final annealing is conducted at a temperature above the temperature about 50° C. above the intermediate annealing temperature, crystals of [111] orientation are preferentially formed so as to obtain a large $\bar{r}$-value with reduced internal anisotropy.

In order to attain a large stiffness, it is necessary that the intermediate annealing temperature ranges between the temperature about 80° C. higher than the recrystallization temperature and about 920° C. and that the final annealing temperature ranges between about 700 and 920° C. Desirable levels of stiffness cannot be obtained when the intermediate annealing temperature is below the temperature which is about 80° C. higher than the recrystallization temperature or when the final annealing temperature is below about 700° C.

According to the invention, the cold-rolled steel sheet after final annealing may be subjected to temper rolling as required. The steel sheet according to the invention may be used after hot-dip zinc plating or electric zinc plating.

EXAMPLE 1

Steel slabs of compositions shown in Table 1 were subjected to a series of steps including primary cold rolling, intermediate annealing, secondary cold rolling and final annealing which are conducted under various conditions as shown in Table 2. Properties of the samples thus obtained also are shown in Table 2. The tensile characteristic was measured by forming JIS-No.5 test piece for tensile test from the samples. The r-value was determined as the mean value of the values measured in three directions, i.e., the L direction coinciding with the rolling direction, the D direction which is 45° to the rolling direction and the C direction which is 90° to the rolling direction, after imparting a tensile pre-stress of 15%. The internal anisotropy of the r-value was determined by measuring the r-value in a plurality of directions at 10° intervals and calculating the difference ($r_{max} - r_{min}$) between the maximum value $r_{max}$ and the minimum value $r_{min}$.

Samples of these steels were also secondarily cold-rolled under the conditions shown in Table 3, followed by final annealing and zinc coating which were conducted though a continuous hot-dip galvanizing line to obtain hot-dip galvanized steel sheets. The results of measurement of properties of these plated steels also are shown in Table 3. Two types of steel sheets, which were plated with zinc and zinc alloy respectively, were used as the test samples.

Samples of these steels were also secondarily cold-rolled and finally annealed under the conditions shown in Table 4, followed by electroplated coating of zinc to obtain electroplated zinc coated steel sheets. The results of measurement of properties of these plated steels also are shown in Table 4. Three types of steel sheets, which were plated with zinc, zinc-nickel alloy and two-layer of zinc and iron respectively, were used as the test samples.

EXAMPLE 2

Steel slabs of compositions shown in Table 5 were subjected to a series of steps including primary cold rolling, intermediate annealing, secondary cold rolling and final annealing which were conducted under various conditions as shown in Table 6. Properties of the samples thus obtained also are shown in Table 6. The Young's modulus was determined by measuring the resonance frequency of the magnetically vibrated samples, as the mean of the values obtained in the measurements in three directions, i.e., the L direction coinciding with the rolling direction, the D direction which is 45° to the rolling direction and the C direction which is 90° to the rolling direction, as is the case of the r-value.

Samples of these steels were also secondarily cold-rolled under the conditions shown in Table 7, followed by final annealing and zinc coating which were conducted though a continuous hot-dip galvanizing line to obtain zinc hot-dip galvanized steel sheets. The results of measurement of properties of these plated steels also are shown in Table 7. Two types of steel sheets, which were plated with zinc and zinc alloy respectively, were used as the test samples.

Samples of these steels were also secondarily cold-rolled and finally annealed under the conditions shown in Table 8, followed by electroplated coating with zinc to obtain electroplated zinc coated steel sheets. The results of measurement of properties of these plated steels also are shown in Table 8. Three types of steel sheets, which were plated with zinc, zinc-nickel alloy and two-layer of zinc and iron respectively, were used as the test samples.

TABLE 1

| | C | Si | Mn | P | S | N | Al | Ti | Nb | B | (%) Sb |
|---|---|---|---|---|---|---|---|---|---|---|---|
| A | 0.002 | 0.01 | 0.12 | 0.011 | 0.011 | 0.002 | 0.045 | 0.041 | — | — | — |
| B | 0.002 | 0.02 | 0.08 | 0.012 | 0.010 | 0.002 | 0.066 | 0.068 | — | 0.0007 | — |
| C | 0.001 | 0.01 | 0.12 | 0.015 | 0.014 | 0.001 | 0.038 | 0.033 | 0.006 | 0.0006 | — |
| D | 0.002 | 0.01 | 0.11 | 0.006 | 0.011 | 0.002 | 0.055 | 0.065 | — | 0.0006 | 0.009 |
| E | 0.002 | 0.02 | 0.11 | 0.011 | 0.003 | 0.002 | 0.052 | — | 0.015 | 0.0007 | — |
| F | 0.002 | 0.02 | 0.12 | 0.009 | 0.010 | 0.001 | 0.038 | — | 0.016 | — | — |
| G | 0.002 | 0.02 | 0.08 | 0.011 | 0.013 | 0.002 | 0.055 | 0.032 | 0.005 | — | — |

TABLE 2

| | | | Cold rolling-Annealing conditions | | | | | | |
|---|---|---|---|---|---|---|---|---|---|
| Sample Nos. | Steel types | Sheet thickness (mm) | Primary rolling reduction (%) | Recrystal-lization temp. (°C.) | Inter-mediate annealing | Secondary rolling reduction (%) | Final annealing | Total rolling reduction (%) | Difference in anneal temp. (pri.-sec.) (°C.) |
| (1) | A | 0.7 | 50 | 720 | 750° C.-20s | 77 | 870° C.-20s | 88 | 120 |
| (2) | B | 0.7 | 67 | 730 | 760° C.-20s | 65 | 850° C.-20s | 88 | 90 |
| (3) | C | 0.7 | 73 | 770 | 810° C.-20s | 56 | 870° C.-20s | 88 | 60 |
| (4) | D | 1.2 | 60 | 660*1 | 720° C.-20h*2 | 50 | 850° C.-20s | 80 | 130 |
| (5) | D | 1.2 | 60 | 660*1 | 700° C.-20h*2 | 50 | 750° C.-5h*2 | 80 | 50 |
| (6) | E | 0.7 | 73 | 770 | 800° C.-20s | 56 | 850° C.-20s | 88 | 50 |
| (7) | F | 0.7 | 73 | 750 | 780° C.-20s | 56 | 870° C.-20s | 88 | 90 |
| (8) | G | 0.7 | 73 | 750 | 770° C.-20s | 56 | 850° C.-20s | 88 | 80 |
| (9) | B | 0.7 | 67 | 730 | 700° C.-20s | 65 | 850° C.-20s | 88 | 150 |
| (10) | C | 0.7 | 80 | 770 | — | — | 870° C.-20s | 80 | — |
| (11) | E | 0.7 | 50 | 770 | 800° C.-20s | 50 | 850° C.-20s | 75 | 50 |
| (12) | F | 0.7 | 85 | 750 | 780° C.-20s | 25 | 870° C.-20s | 88 | 90 |

| | Properties | | | | | |
|---|---|---|---|---|---|---|
| Sample Nos. | Y.S. (kg/mm$^2$) | T.S. (kg/mm$^2$) | El (%) | $\bar{r}$ | Γ max - Γ min | Remarks |
| (1) | 13 | 29 | 55 | 3.3 | 0.3 | Samples meeting conditions of invention |
| (2) | 13 | 28 | 56 | 3.4 | 0.3 | |
| (3) | 14 | 30 | 54 | 3.3 | 0.3 | |
| (4) | 13 | 29 | 59 | 3.0 | 0.4 | |
| (5) | 12 | 28 | 60 | 3.0 | 0.3 | |
| (6) | 14 | 30 | 54 | 3.1 | 0.4 | |
| (7) | 13 | 29 | 53 | 3.0 | 0.3 | |
| (8) | 13 | 29 | 54 | 3.2 | 0.4 | |
| (9) | 13 | 28 | 50 | 2.2 | 0.6 | Comparison samples |
| (10) | 15 | 31 | 50 | 2.2 | 1.3 | |
| (11) | 14 | 30 | 54 | 2.2 | 0.8 | |
| (12) | 13 | 29 | 50 | 2.2 | 1.3 | |

*1Re-crystallization temperature in batch annealing cycle
*2Batch annealing

TABLE 3

| | | | | Cold rolling-Annealing conditions | | | | | | |
|---|---|---|---|---|---|---|---|---|---|---|
| Sample Nos. | Steel types | Sheet thickness (mm) | Type of plating | Primary rolling reduction (%) | Recrystal-lization temp. (°C.) | Inter-mediate annealing | Secondary rolling reduction (%) | Final annealing | Total rolling reduction (%) | Difference in anneal temp. (pri.-sec.) (°C.) |
| (13) | A | 0.7 | Zn-plating | 50 | 720 | 750° C.-20s | 77 | 870° C.-20s | 88 | 120 |
| (14) | C | 0.7 | Alloyed Zn-plating | 73 | 770 | 810° C.-20s | 56 | 870° C.-20s | 88 | 60 |
| (15) | E | 0.7 | Alloyed Zn-plating | 73 | 770 | 800° C.-20s | 56 | 850° C.-20s | 88 | 50 |
| (16) | F | 0.7 | Alloyed Zn-plating | 73 | 750 | 780° C.-20s | 56 | 850° C.-20s | 88 | 70 |
| (17) | G | 0.7 | Alloyed Zn-plating | 73 | 750 | 770° C.-20s | 56 | 850° C.-20s | 88 | 80 |

| | Properties | | | | |
|---|---|---|---|---|---|
| Sample Nos. | Y.S. (kg/mm$^2$) | T.S. (kg/mm$^2$) | El (%) | $\bar{r}$ | Γ max - Γ min |
| (13) | 13 | 29 | 54 | 3.2 | 0.3 |
| (14) | 14 | 30 | 53 | 3.3 | 0.3 |
| (15) | 14 | 30 | 53 | 3.0 | 0.4 |

TABLE 3-continued

| | | | | | |
|---|---|---|---|---|---|
| (16) | 14 | 30 | 52 | 2.9 | 0.4 |
| (17) | 13 | 29 | 53 | 3.1 | 0.4 |

*Final anneal: Hot-dip zinc plating line

TABLE 4

| | | | | Cold rolling-Annealing conditions | | | | | | |
|---|---|---|---|---|---|---|---|---|---|---|
| Sample Nos. | Steel types | Sheet thickness (mm) | Type of plating | Primary rolling reduction (%) | Recrystal-lization temp. (°C.) | Inter-mediate annealing | Secondary rolling reduction (%) | Final annealing | Total rolling reduction (%) | Difference in anneal temp. (pri.-sec.) (°C.) |
| (18) | A | 0.7 | Zn-plating | 50 | 720 | 750° C.-20s | 77 | 870° C.-20s | 88 | 120 |
| (19) | B | 0.7 | Zn—Ni plating | 67 | 730 | 760° C.-20s | 65 | 850° C.-20s | 88 | 90 |
| (20) | C | 0.7 | Zn—Fe plating | 73 | 770 | 810° C.-20s | 56 | 870° C.-20s | 88 | 60 |
| (21) | E | 0.7 | Zn—Ni plating | 73 | 770 | 800° C.-20s | 56 | 850° C.-20s | 88 | 50 |
| (22) | F | 0.7 | Zn-plating | 73 | 750 | 780° C.-20s | 56 | 870° C.-20s | 88 | 90 |
| (23) | G | 0.7 | Zn—Fe plating | 73 | 750 | 770° C.-20s | 56 | 850° C.-20s | 88 | 80 |

| | Properties | | | | |
|---|---|---|---|---|---|
| Sample Nos. | Y.S. (kg/mm$^2$) | T.S. (kg/mm$^2$) | El (%) | $\bar{r}$ | Γ max - Γ min |
| (18) | 13 | 29 | 54 | 3.2 | 0.3 |
| (19) | 13 | 28 | 55 | 3.3 | 0.3 |
| (20) | 14 | 30 | 53 | 3.2 | 0.3 |
| (21) | 14 | 30 | 53 | 3.0 | 0.4 |
| (22) | 13 | 29 | 52 | 2.9 | 0.3 |
| (23) | 13 | 29 | 53 | 3.1 | 0.4 |

*Electroplating line

TABLE 5

| | C | Si | Mn | P | S | N | Al | Ti | Nb | B | (%) Sb |
|---|---|---|---|---|---|---|---|---|---|---|---|
| H | 0.002 | 0.02 | 0.11 | 0.011 | 0.010 | 0.002 | 0.031 | 0.042 | — | — | — |
| I | 0.001 | 0.02 | 0.08 | 0.013 | 0.011 | 0.002 | 0.055 | 0.066 | — | 0.0007 | — |
| J | 0.002 | 0.01 | 0.12 | 0.010 | 0.003 | 0.001 | 0.043 | 0.031 | 0.006 | 0.0006 | — |
| K | 0.002 | 0.01 | 0.11 | 0.013 | 0.014 | 0.002 | 0.063 | 0.062 | — | 0.0007 | 0.009 |
| L | 0.001 | 0.02 | 0.14 | 0.006 | 0.010 | 0.001 | 0.052 | — | 0.015 | 0.0006 | — |
| M | 0.002 | 0.01 | 0.06 | 0.012 | 0.012 | 0.002 | 0.066 | — | 0.016 | — | — |
| N | 0.002 | 0.01 | 0.11 | 0.010 | 0.011 | 0.002 | 0.049 | 0.022 | 0.009 | — | — |

TABLE 6

| | | | Cold rolling-Annealing conditions | | | | | | |
|---|---|---|---|---|---|---|---|---|---|
| Sample Nos. | Steel types | Sheet thickness (mm) | Primary rolling reduction (%) | Recrystal-lization temp. (°C.) | Inter-mediate annealing | Secondary rolling reduction (%) | Final annealing | Total rolling reduction (%) | Reduction difference (Primary-Secondary) (%) |
| (24) | H | 0.7 | 73 | 720 | 850° C.-20s | 56 | 870° C.-20s | 88 | 17 |
| (25) | I | 0.7 | 67 | 730 | 850° C.-20s | 65 | 870° C.-20s | 88 | 2 |
| (26) | J | 0.7 | 73 | 770 | 870° C.-20s | 56 | 870° C.-20s | 88 | 17 |
| (27) | K | 1.2 | 60 | 660 | 880° C.-20s | 50 | 720° C.-20h* | 80 | 10 |
| (28) | L | 0.7 | 73 | 770 | 860° C.-20s | 56 | 870° C.-20s | 88 | 17 |
| (29) | M | 0.7 | 67 | 750 | 870° C.-20s | 65 | 870° C.-20s | 88 | 2 |
| (30) | N | 0.7 | 67 | 750 | 840° C.-20s | 65 | 850° C.-20s | 88 | 2 |
| (31) | N | 0.7 | 60 | 750 | 850° C.-20s | 70 | 850° C.-20s | 88 | −10 |
| (32) | J | 0.7 | 50 | 770 | 880° C.-20s | 50 | 850° C.-20s | 75 | 0 |
| (33) | M | 0.7 | 80 | 750 | — | — | 870° C.-20s | 80 | — |

| | Properties | | | | | |
|---|---|---|---|---|---|---|
| Sample Nos. | Y.S. (kg/mm$^2$) | T.S. (kg/mm$^2$) | El (%) | $\bar{r}$ | Young's modulus (kg/mm$^2$) | Remarks |
| (24) | 13 | 29 | 55 | 3.0 | 23200 | Samples meeting conditions of invention |
| (25) | 13 | 28 | 55 | 3.4 | 23300 | |
| (26) | 14 | 30 | 54 | 3.0 | 23200 | |
| (27) | 13 | 28 | 59 | 2.8 | 23200 | |
| (28) | 14 | 29 | 54 | 3.0 | 23200 | |
| (29) | 13 | 30 | 53 | 3.0 | 23300 | |
| (30) | 13 | 29 | 54 | 3.3 | 23200 | |
| (31) | 13 | 29 | 54 | 2.8 | 22500 | |
| (32) | 14 | 30 | 54 | 2.2 | 22100 | Comparison samples |

TABLE 6-continued

| | | | | | |
|---|---|---|---|---|---|
| (33) | 15 | 31 | 50 | 2.0 | 22100 |

*Batch annealing

TABLE 7

| Sample Nos. | Steel types | Sheet thickness (mm) | Type of plating | Cold rolling-Annealing conditions: Primary rolling reduction (%) | Inter-mediate annealing | Secondary rolling reduction (%) | Final annealing | Total rolling reduction (%) | Reduction difference (Primary-Secondary) (%) |
|---|---|---|---|---|---|---|---|---|---|
| (34) | H | 0.7 | Zn-plating | 73 | 850° C.-20s | 56 | 870° C.-20s | 88 | 17 |
| (35) | J | 0.7 | Alloyed Zn-plating | 73 | 870° C.-20s | 56 | 870° C.-20s | 88 | 17 |
| (36) | L | 0.7 | Alloyed Zn-plating | 73 | 860° C.-20s | 56 | 870° C.-20s | 88 | 17 |
| (37) | M | 0.7 | Alloyed Zn-plating | 67 | 870° C.-20s | 65 | 870° C.-20s | 88 | 2 |
| (38) | N | 0.7 | Alloyed Zn-plating | 67 | 840° C.-20s | 65 | 870° C.-20s | 88 | 2 |

| Sample Nos. | Properties: Y.S. (kg/mm$^2$) | T.S. (kg/mm$^2$) | El (%) | $\bar{r}$ | Young's modulus (kg/mm$^2$) |
|---|---|---|---|---|---|
| (34) | 13 | 29 | 54 | 2.9 | 23200 |
| (35) | 14 | 30 | 53 | 2.9 | 23200 |
| (36) | 14 | 29 | 53 | 2.9 | 23200 |
| (37) | 13 | 30 | 52 | 2.9 | 23300 |
| (38) | 13 | 29 | 53 | 2.9 | 23200 |

*Final annealing: Hot-dip zinc plating line

TABLE 8

| Sample Nos. | Steel types | Sheet thickness (mm) | Type of plating | Cold rolling-Annealing conditions: Primary rolling reduction (%) | Inter-mediate annealing | Secondary rolling reduction (%) | Final annealing | Total rolling reduction (%) | Reduction difference (Primary-Secondary) (%) |
|---|---|---|---|---|---|---|---|---|---|
| (39) | H | 0.7 | Zn-plating | 73 | 850° C.-20s | 56 | 870° C.-20s | 88 | 17 |
| (40) | I | 0.7 | Zn—Ni plating | 67 | 850° C.-20s | 65 | 870° C.-20s | 88 | 2 |
| (41) | J | 0.7 | Zn—Fe plating | 73 | 870° C.-20s | 56 | 870° C.-20s | 88 | 17 |
| (42) | L | 0.7 | Zn—Ni plating | 73 | 860° C.-20s | 56 | 870° C.-20s | 88 | 17 |
| (43) | M | 0.7 | Zn-plating | 67 | 870° C.-20s | 65 | 870° C.-20s | 88 | 2 |
| (44) | N | 0.7 | Zn—Fe plating | 67 | 840° C.-20s | 65 | 870° C.-20s | 88 | 2 |

| Sample Nos. | Properties: Y.S. (kg/mm$^2$) | T.S. (kg/mm$^2$) | El (%) | $\bar{r}$ | Young's modulus (kg/mm$^2$) |
|---|---|---|---|---|---|
| (39) | 13 | 29 | 54 | 2.9 | 23200 |
| (40) | 13 | 28 | 54 | 3.0 | 23300 |
| (41) | 14 | 30 | 53 | 2.9 | 23200 |
| (42) | 14 | 29 | 53 | 2.9 | 23200 |
| (43) | 13 | 30 | 52 | 2.9 | 23300 |
| (44) | 13 | 29 | 54 | 2.9 | 23200 |

*Electroplating line

As will be understood from the data shown in the Tables, according to the present invention, it is possible to obtain a cold-rolled steel sheet which simultaneously possesses both a deep drawability much superior to that of known steel sheets and a small anisotropy of r-value or both a deep drawability much superior to that of known steel sheets and a superior stiffness. The cold-rolled steel sheet of the invention, therefore, makes it possible to integrally form a large panel which could never be formed conventionally or to form a complicated part such as an automotive oil pan which hitherto has been difficult to form integrally. Furthermore, the cold steel sheets of the invention can be subjected to various surface treatments, thus offering remarkable industrial advantages.

WHAT IS CLAIMED IS:

1. A method of producing a cold-rolled steel sheet suitable for deep drawing, comprising:

preparing a blank steel material having a composition containing up to about 0.005 wt % of C, up to about 0.1 wt % of Si, up to about 1.0 wt % of Mn, up to about 0.1 wt % of P, up to about 0.05 wt % of S, about 0.01 to 0.10 wt % of Al, up to about 0.005 wt % of N, one, two or more elements selected from the group consisting of about 0.01 to 0.15 wt % of Ti, about 0.001 to 0.05 wt % of Nb and about 0.0001 to 0.0020 wt % of B, and the balance substantially Fe and incidental impurities;

subjecting said material to a hot rolling;

conducting primary cold rolling on said material at a rolling reduction not smaller than about 30%;

conducting intermediate annealing on said material at a temperature ranging between the recrystallization temperature and about 920°;

conducting secondary cold rolling on said material at a rolling reduction of not smaller than about 30% so as to provide a total rolling reduction not smaller than about 78%; and conducting final annealing on said material at a temperature which is between the recrystallization temperature and about 920° C.

2. A method according to claim 1, wherein said intermediate annealing is effected at a temperature between the recrystallization temperature and a temperature which is about 80° C. higher than the recrystallization temperature, while said final annealing is conducted at a temperature between a temperature which is about 50° C. higher than the intermediate annealing temperature and about 920° C., whereby a cold rolled steel sheet having a small internal anisotropy is obtained.

3. A method according to claim 1, wherein said primary cold rolling is conducted at a rolling reduction not smaller than about 50%, said intermediate annealing is effected at a temperature between a temperature which is about 80° C. higher than the recrystallization temperature and about 920° C., said secondary cold rolling is conducted at a rolling reduction smaller than that in said primary cold rolling, the difference between the rolling reduction in said primary cold rolling and that in said secondary cold rolling being not greater than about 30%, and said final annealing is conducted at a temperature between about 700° C. and 920° C., whereby a cold rolled steel having a stiffness is obtained.

4. A method according to one of claims 1 to 3, wherein said blank steel material further contains about 0.001 to 0.20 wt % of Sb.

5. A cold-rolled steel sheet suitable for deep drawing, said steel sheet being made from a steel having a composition containing up to about 0.005 wt % of C, up to about 0.1 wt % of Si, up to about 1.0 wt % of Mn, up to about 0.1 wt % of P, up to about 0.05 wt % of S, about 0.01 to 0.10 wt % of Al, up to about 0.005 wt % of N, one, two or more elements selected from the group consisting of about 0.01 to 0.15 wt % of Ti, about 0.001 to 0.05 wt % of Nb and about 0.0001 to 0.0020 wt % of B, and the balance substantially Fe and incidental impurities; said steel sheet exhibiting a Lankford value (r-value) of $\bar{r} \geqq$ about 2.8 and the difference ($r_{max} - r_{min}$) between the maximum value $r_{max}$ and the minimum value $r_{min}$ satisfying the condition of ($r_{max} - r_{min}$) $\leqq$ about 0.5.

6. A Cold-rolled steel sheet suitable for deep drawing, said steel sheet being made from a steel having a composition containing up to about 0.005 wt % of C, up to about 0.1 wt % of Si, up to about 1.0 wt % of Mn, up to about 0.1 wt % of P, up to about 0.05 wt % of S, about 0.01 to 0.10 wt % of Al, up to about 0.005 wt % of N, one, two or more elements selected from the group consisting of about 0.01 to 0.15 wt % of Ti, about 0.001 to 0.05 wt % of Nb and about 0.0001 to 0.0020 wt % of B, and the balance substantially Fe and incidental impurities; said steel sheet exhibiting a Lankford value of $\bar{r} \geqq$ 2.8 and a Young's modulus of at least 23000 kg/mm$^2$.

7. A cold-rolled steel sheet according to one of claims 5 or 6, wherein said blank steel material further contains about 0.001 to 0.20 wt % of Sb.

* * * * *

UNITED STATES PATENT AND TRADEMARK OFFICE

CERTIFICATE OF CORRECTION

PATENT NO. : 5,041,166

DATED : August 20, 1991

INVENTOR(S) : Saiji Matsuoka et al

It is certified that error appears in the above-identified patent and that said Letters Patent is hereby corrected as shown below:

Column 2, line 8, change "57-81361" to --57-181361--..

In column 7, line 52, please change "803C" to --80°C--.

In columns 9 and 10, Table 3, please change the subheading "Γ max Γ min" to --r max r min--.

In columns 11 and 12, Table 4, please change the subheading "Γ max Γ min" to --r max r min--.

Signed and Sealed this

First Day of June, 1993

*Attest:*

Michael K. Kirk

MICHAEL K. KIRK

*Attesting Officer*

*Acting Commissioner of Patents and Trademarks*